US009765596B2

(12) United States Patent
Savari et al.

(10) Patent No.: US 9,765,596 B2
(45) Date of Patent: Sep. 19, 2017

(54) ENGINEERED LCM DESIGN TO MANAGE SUBTERRANEAN FORMATION STRESSES FOR ARRESTING DRILLING FLUID LOSSES

(71) Applicant: Halliburton Energy Services, Inc., Houston, TX (US)

(72) Inventors: Sharath Savari, Kingwood, TX (US); Dale E. Jamison, Humble, TX (US); Robert J. Murphy, Kingwood, TX (US); Siva Rama Krishna Jandhyala, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 394 days.

(21) Appl. No.: 14/336,203

(22) PCT Filed: Sep. 30, 2013

(86) PCT No.: PCT/US2013/062609
§ 371 (c)(1),
(2) Date: Jul. 21, 2014

(87) PCT Pub. No.: WO2015/047389
PCT Pub. Date: Apr. 2, 2015

(65) Prior Publication Data

US 2016/0215593 A1 Jul. 28, 2016

(51) Int. Cl.
*G06G 7/48* (2006.01)
*E21B 41/00* (2006.01)
(Continued)

(52) U.S. Cl.
CPC ..... *E21B 41/0092* (2013.01); *E21B 7/00* (2013.01); *E21B 21/003* (2013.01)

(58) Field of Classification Search
CPC ..... E21B 21/003
(Continued)

(56) References Cited

U.S. PATENT DOCUMENTS 5,905,061 A 5/1999 Patel
5,977,031 A 11/1999 Patel
(Continued)

FOREIGN PATENT DOCUMENTS

WO 2012106348 A2 8/2012
WO 2015047389 A1 4/2015

OTHER PUBLICATIONS

Whitfill Lost Circulation Material Selection, Particle Size Distribution and Fracture Modeling with Fracture Simulation Software; SPE 115039; 2006; pp. 1-12.*
(Continued)

*Primary Examiner* — Hugh Jones
(74) *Attorney, Agent, or Firm* — McDermott Will & Emery LLP

(57) ABSTRACT

Methods for designing lost circulation materials for use in drilling wellbores penetrating subterranean formations may involve inputting a plurality of first inputs into a numerical method, the plurality of first inputs comprising a lost circulation material property input of a first LCM; calculating a plurality of first outputs from the numerical method; inputting a plurality of second inputs into the numerical method, the plurality of second inputs comprising the lost circulation material property input of a second lost circulation material; calculating a plurality of second outputs from the numerical method; comparing the first outputs to the second outputs; and developing a drilling fluid comprising a third lost circulation material based on the comparison of outputs.

17 Claims, 7 Drawing Sheets

(51) Int. Cl.
*E21B 21/00* (2006.01)
*E21B 7/00* (2006.01)

(58) Field of Classification Search
USPC ..... 703/10
See application file for complete search history.

(56) References Cited

U.S. PATENT DOCUMENTS

| | | | | |
|---|---|---|---|---|
| 6,828,279 | B2 | 12/2004 | Patel et al. | |
| 6,861,392 | B2 | 3/2005 | Shaarpour | |
| 7,284,611 | B2 | 10/2007 | Reddy et al. | |
| 7,534,745 | B2 | 5/2009 | Taylor et al. | |
| 7,645,723 | B2 | 1/2010 | Kirsner et al. | |
| 7,696,131 | B2 | 4/2010 | Oyler et al. | |
| 8,043,997 | B2 | 10/2011 | Whitfill et al. | |
| 2008/0147367 | A1 | 6/2008 | Massingill et al. | |
| 2010/0088078 | A1 | 4/2010 | Geehan et al. | |
| 2010/0181073 | A1* | 7/2010 | Dupriest ..... | C09K 8/03 166/308.1 |
| 2010/0250204 | A1 | 9/2010 | Leonard et al. | |
| 2013/0143777 | A1 | 6/2013 | Wang | |
| 2013/0204588 | A1 | 8/2013 | Copeland | |

OTHER PUBLICATIONS

Whitfill: Pre-treating fluids with lost circulation materials; Drilling Contractor; 2004; pp. 54-57.*

Whitfill et al.: Managing Circulation Losses with Synthetic Base Drilling Fluid; paper AADE-03-NTCE-39; AADE technical conference; 2003; pp. 1-10.*

Thesis, FEA Model for Wellbore Strengthening, Thesis UT Austin, Dec. 2011, 65 pages.

Savari et al., "Wellbore Integrity Management: Dealing with Uncertainties," Society of Petroleum Engineers, 2012, SPE 153359, pp. 1-11.

Wang et al., "Investigation of Factors for Strengthening a Wellbore by Propping Fractures," SPE Drilling & Completion, 2009, SPE112629, pp. 441-451.

Whitfill, Don, "Lost Circulation Material Selection, Particle Size Distribution and Fracture Modeling with Fracture Simulation Software," 2008, IADC/SPE 115039, pp. 1-12.

Whitfill et al., "New Design Models and Materials Provide Engineered Solutions to Lost Circulation," Society of Petroleum Engineers, 2006, SPE 101693, pp. 1-14.

Wang et al., "The Key to Successfully Applying Today's Lost-Circulation Solutions," Society of Petroleum Engineers, 2005, SPE 95895, pp. 1-15.

Tare et al., "Drilling Fluid Losses and Gains: Case Histories and Practical Solutions," Society of Petroleum Engineers, 2001, SPE 71368, pp. 1-8.

Sweatman et al., "Formation Pressure Integrity Treatments Optimize Drilling and Completion of Hthp Production Hole Sections," Society of Petroleum Engineers, 2001, SPE 68946, pp. 1-13.

Halliburton Brochure, Steelseal®: Specialty Lost Circulation Particulate, 2012, 2 pages.

Whitfill, Don,"Technology Solution Helps Reduce Drilling Non-Productive Time from Lost Circulation by Increasing Near-Wellbore Area Strength," Fuel Newsletter, 2006, 2 pages.

Halliburton brochure "Wellbore Stress Management™ Service," Baroid Fluid Services, 2006, 2 pages.

Halliburton Brochure "Engineered WellSET™ Treatment Service Helps Prevent Lost Circulation by Strengthening the Wellbore," Baroid Fluid Services, 2007, 2 pages.

Song et al., "Preventing Mud Losses by Wellbore Strengthening," Society of Petroleum Engineers, 2006, SPE 101593, pp. 1-3.

International Search Report and Written Opinion for PCT/US2013/062609 dated Jun. 27, 2014, 9 pages.

* cited by examiner

ENGINEERED LCM DESIGN TO MANAGE SUBTERRANEAN FORMATION STRESSES FOR ARRESTING DRILLING FLUID LOSSES

BACKGROUND

The present invention relates to methods for designing lost circulation materials ("LCM") for use in drilling wellbores penetrating subterranean formations.

Lost circulation is one of the larger contributors to non-productive time during drilling operations. Lost circulation arises from drilling fluid leaking into the formation via undesired flow paths, e.g., permeable sections, natural fractures, and induced fractures. Lost circulation treatments may be used to remediate the wellbore by plugging the undesired flow paths before drilling can resume.

Drilling, most of the time, is performed with an overbalance pressure such that the wellbore pressure, which is related to the equivalent circulating density, is maintained within the mud weight window, i.e., the area between the pore pressure (or collapse pressure) and the fracture pressure at a given depth, see FIG. 1. That is, the pressure is maintained high enough to stop subterranean formation fluids from entering the wellbore and low enough to not create or unduly extend fractures surrounding the wellbore. The term "overbalance pressure," as used herein, refers to the amount of pressure in the wellbore that exceeds the pore pressure. The term "pore pressure," as used herein, refers to the pressure of fluids in the formation. Overbalance pressure is needed to prevent subterranean formation fluids from entering the wellbore. The term "fracture pressure," as used herein, refers to the pressure threshold where pressures exerted in excess of this value from the wellbore onto the formation will cause one or more fractures in the subterranean formation. Wider mud weight windows allow for drilling with a reduced risk of lost circulation.

In common subterranean formations, the mud weight window may be wide, e.g., FIG. 1. However, in formations having problematic zones, e.g., depleted zones, high-permeability zones, highly tectonic areas with high in situ stresses, or pressurized shale zones below salt layers, which are often found in formations with a plurality of lithographies, the mud weight window may be narrower and more variable, e.g., FIG. 2. When the overbalance pressure exceeds the fracture pressure, a fracture is expected to be induced in the formation, and lost circulation may occur. One proactive method of reducing the risk of lost circulation is to strengthen or stabilize the wellbore through the use of LCM. One such method involves shutting-in a drilling fluid comprising LCM and then pressurizing the wellbore so as to induce fractures while simultaneously plugging the fractures with the LCM. Typically, the pressurizing is done as a step-function process until a desired pressure is reached or until a point of diminishing returns (i.e., minimal pressure increases at each step-function). This simultaneous fracture-plug method increases the compressive tangential stress in the near-wellbore region of the subterranean formation (described further herein), which translates to an increase in the fracture initiation pressure or fracture reopening pressure (i.e., an increase in the minimum pressure to initiate or reopen a fracture), thereby widening the mud weight window (e.g., FIG. 3).

Expansion of the mud weight window may translate to cost savings because wellbores that are strengthened to a higher degree allow for safely drilling longer sections of a wellbore, which translates to less non-productive time and decreased costs. Further, longer drilled sections enable longer casing sections. Because each subsequent casing section is at a smaller diameter than the previous section, greater wellbore strengthening may ultimately allow for deeper wellbores and the capabilities to access previously untapped resources.

The plug may perform a variety of functions including keeping the induced fractures propped open, preserving the increased circumferential (hoop) stress that was required to open the fractures, isolating the fracture tips from the fluid and pressure of the wellbore, and any combination thereof. FIG. 4 provides an illustration of a plugged fracture and some of the related stresses including the wellbore pressure that is radially exerted from the wellbore and fluid therein onto the subterranean formation, the hoop stress that is a circumferential pressure in the subterranean formation about the wellbore, the fracture pressure that is the pressure the fluid in the fracture exerts on the proximal portion of the subterranean formation, and the formation pressure that the subterranean formation exerts on, for example, the fracture. The hoop stress is illustrated with arrow pointing toward the fracture, i.e., as a compressive tangential stress, which is the state where the wellbore is stabilized. It should be noted that the formation pressure is also a component of the hoop stress. However, the hoop stress may be a tensive tangential stress with arrow pointing away from the fracture, which is a state where fractures are induced.

As the practice of wellbore strengthening, especially in deep water wells, has increased, so have the number of LCM and potential LCM and related methods. Typically, the choice of which LCM to use, at what concentration (or relative concentrations for more than one LCM) is determined by the properties of the LCM in consideration of the downhole conditions. However, as shown in FIG. 4, the systems downhole can be quite complex with a plurality of stresses and a complex structure of fractures (e.g., uneven surfaces and uneven widths). As such, in the field, many wellbores may be inefficiently strengthened, e.g., with a less effective LCM or at less effective concentrations. Further, in-the-field testing of the various LCM increase the time and cost associated with drilling the wellbore.

Accordingly, understanding how plugs comprising different LCM cause the various stresses experienced in a wellbore to change may advantageously allow for the design of LCM that better strengthen the wellbore, thereby minimizing fluid loss and consequently reducing rig downtime and associated costs.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
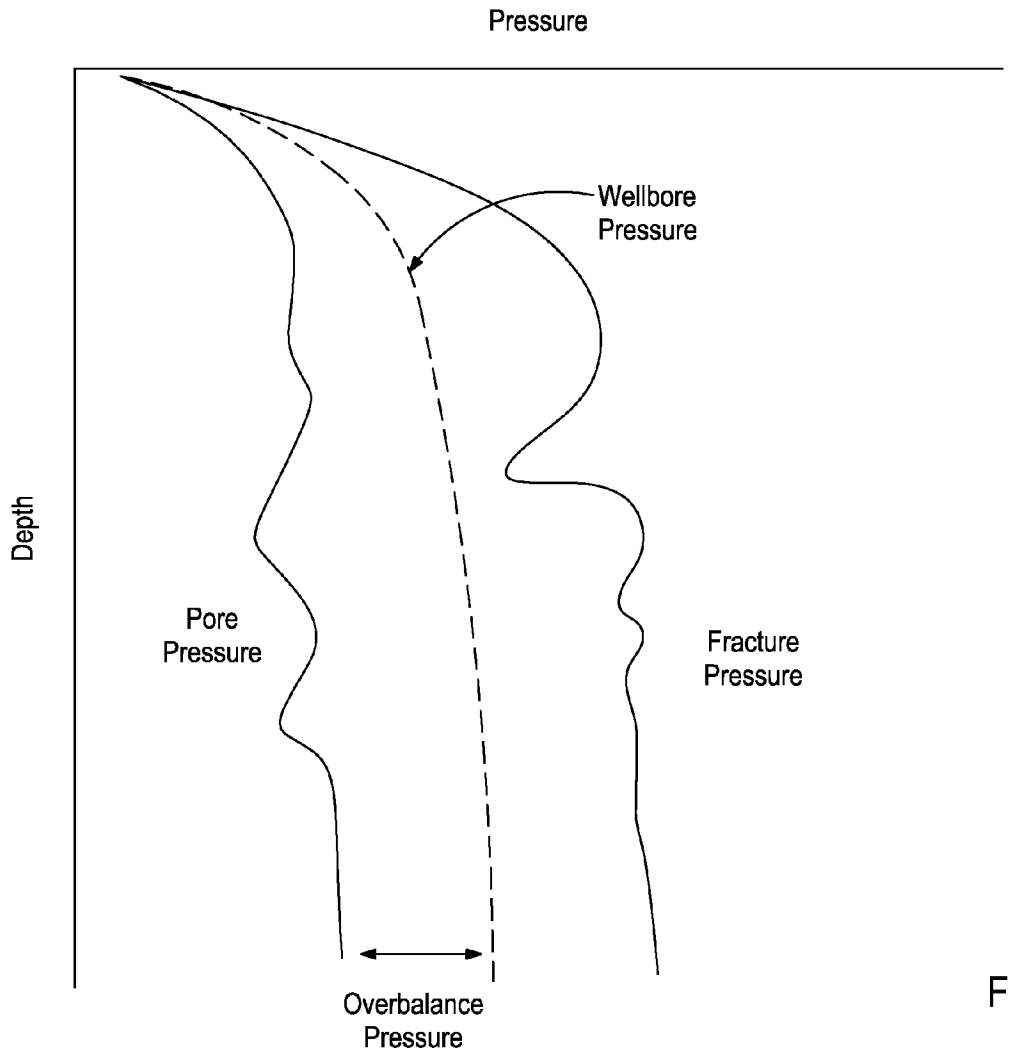
FIG. 1 illustrates the mud weight window for a traditional wellbore.
Figure 2:
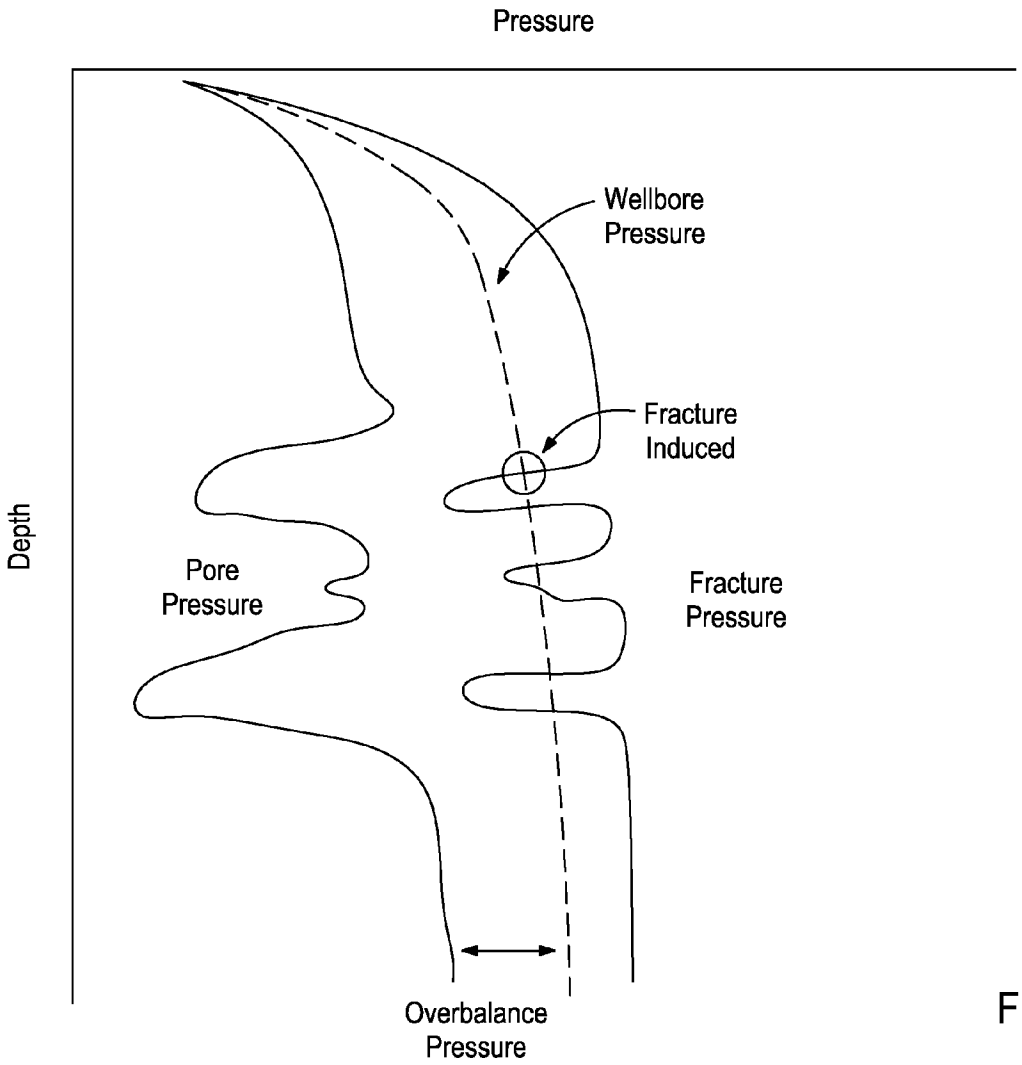
FIG. 2 illustrates a narrow and complex mud weight window.
Figure 3:
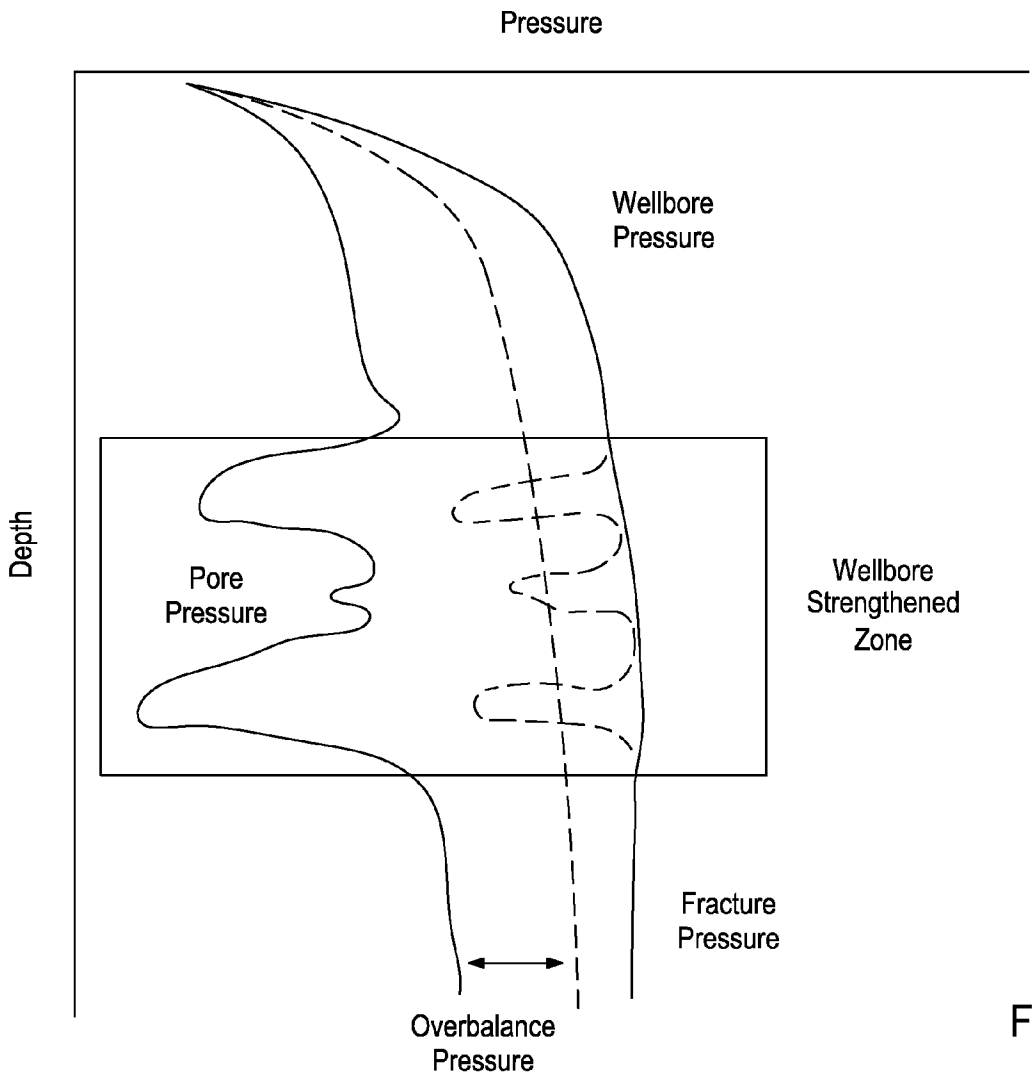
FIG. 3 illustrates the mud weight window for a strengthened wellbore.
Figure 4:
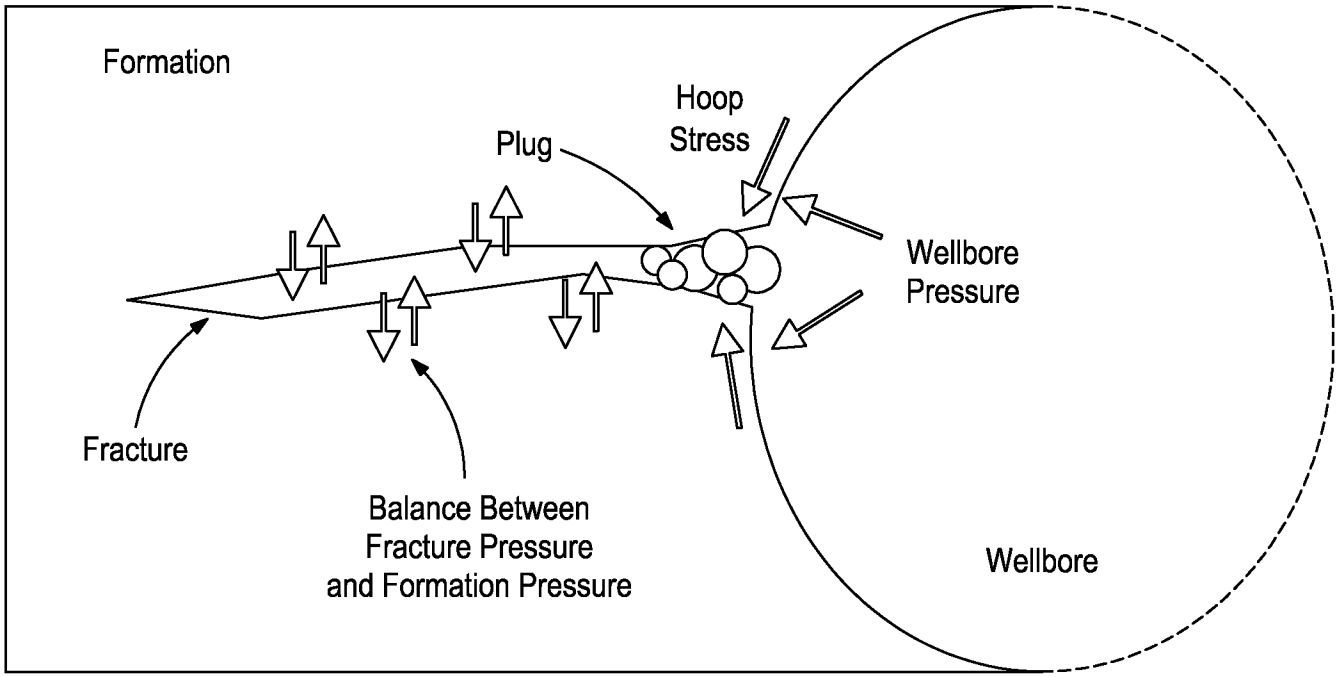
FIG. 4 illustrates some of the downhole pressures relating to wellbore strengthening.

The present invention relates to methods for designing LCM and drilling fluids for use in drilling wellbores penetrating subterranean formations. Such design of the LCM may utilize numerical methods with a plurality of inputs and outputs.

The numerical methods described herein may, in some embodiments, utilize the properties or parameters of the LCM, properties of a plug of the LCM, the wellbore, and the subterranean formation as inputs to provide outputs like the properties of a plug of the LCM, the wellbore stresses, and the failure characteristics of the plug with changes in the pressure applied within the wellbore (e.g., simulating pressurizing in wellbore strengthening operations). Such outputs may be used to design LCM for in-the-field use.

Further, in some instances, the numerical methods described herein (or hybrids thereof) may be utilized at a wellsite with additional inputs from a drilling operation (e.g., pressure readings, drilling speed, and the like), a previous wellbore strengthening operation (e.g., pressure readings, pressure changes over time, properties of the LCM utilized, and the like), and any combination thereof. Based on the outputs of the numerical methods utilizing such inputs, during subsequent drilling or wellbore strengthening operations the LCM utilized may be changed to enhance wellbore strengthening. For example, if two LCM are currently being utilized, the numerical methods may provide outputs that suggest the relative ratios of the two LCM should be modified to increase the strength of the wellbore (i.e., allow for a higher equivalent circulating density).

In some embodiments, the numerical methods described herein provide a route to more quickly and more cost effectively (relative to in-the-field testing or in-lab testing) analyze the extent of wellbore strengthening from various LCM and combination of LCM. As such, the implementation of better wellbore strengthening technologies may be implemented in the field more quickly, which, as described above, may provide for drilling of longer sections of a wellbore and ultimately allow for deeper wellbores and the capabilities to access previously untapped resources.

It should be noted that when "about" is provided at the beginning of a numerical list, "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

I. Drilling Fluids and Lost Circulation Materials

The drilling fluids described herein may comprise a base fluid and an LCM. As used herein, the term "LCM" should not be read as limiting to a single type of LCM but rather encompasses a single LCM and a mixture of two or more LCM where the two or more LCM may differ in at least one way selected from size, shape, aspect ratio, porosity, pore size, permeability, mechanical property, wetting contact angle, adhesiveness, electrical or magnetic property, electrostatic charge, chemical reactivity, thermal stability, composition, and any combination thereof.

Suitable base fluids may comprise oil-based fluids, aqueous-based fluids, aqueous-miscible fluids, water-in-oil emulsions, or oil-in-water emulsions. Suitable oil-based fluids may include alkanes, olefins, aromatic organic compounds, cyclic alkanes, paraffins, diesel fluids, mineral oils, desulfurized hydrogenated kerosenes, esters, and any combination thereof. Suitable aqueous-based fluids may include fresh water, saltwater (e.g., water containing one or more salts dissolved therein), brine (e.g., saturated salt water), seawater, and any combination thereof. Suitable aqueous-miscible fluids may include, but not be limited to, alcohols (e.g., methanol, ethanol, n-propanol, isopropanol, n-butanol, sec-butanol, isobutanol, and t-butanol); glycerins; glycols (e.g., polyglycols, propylene glycol, and ethylene glycol); polyglycol amines; polyols; any derivative thereof; any in combination with salts (e.g., sodium chloride, calcium chloride, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, potassium carbonate, and any combination thereof); any in combination with an aqueous-based fluid; and any combination thereof. Suitable water-in-oil emulsions, also known as invert emulsions, may have an oil-to-water ratio from a lower limit of greater than about 50:50, 55:45, 60:40, 65:35, 70:30, 75:25, or 80:20 to an upper limit of less than about 100:0, 95:5, 90:10, 85:15, 80:20, 75:25, 70:30, or 65:35 by volume in the base treatment fluid, where the amount may range from any lower limit to any upper limit and encompass any subset therebetween. Examples of suitable invert emulsions include those disclosed in U.S. Pat. No. 5,905,061 entitled "Invert Emulsion Fluids Suitable for Drilling" filed on May 23, 1997, U.S. Pat. No. 5,977,031 entitled "Ester Based Invert Emulsion Drilling Fluids and Muds Having Negative Alkalinity" filed on Aug. 8, 1998, U.S. Pat. No. 6,828,279 entitled "Biodegradable Surfactant for Invert Emulsion Drilling Fluid" filed on Aug. 10, 2001, U.S. Pat. No. 7,534,745 entitled "Gelled Invert Emulsion Compositions Comprising Polyvalent Metal Salts of an Organophosphonic Acid Ester or an Organophosphinic Acid and Methods of Use and Manufacture" filed on May 5, 2004, U.S. Pat. No. 7,645,723 entitled "Method of Drilling Using Invert Emulsion Drilling Fluids" filed on Aug. 15, 2007, and U.S. Pat. No. 7,696,131 entitled "Diesel Oil-Based Invert Emulsion Drilling Fluids and Methods of Drilling Boreholes" filed on Jul. 5, 2007, each of which are incorporated herein by reference in their entirety. It should be noted that for water-in-oil and oil-in-water emulsions, any mixture of the above may be used including the water being and/or comprising an aqueous-miscible fluid.

In some embodiments, LCM may comprise particulate, fibers, or both. Suitable LCM may include those comprising materials suitable for use in a subterranean formation, which may include, but are not limited to, any known lost circulation material, bridging agent, fluid loss control agent, diverting agent, plugging agent, and the like, and any combination thereof. Examples of suitable materials may include, but are not be limited to, sand, shale, ground marble, bauxite, ceramic materials, glass materials, metal pellets, high strength synthetic fibers, resilient graphitic carbon, cellulose flakes, wood, resins, polymer materials (crosslinked or otherwise), polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, composite materials, and any combination thereof. Suitable composite materials may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and any combination thereof.

Specific examples of suitable particulates may include, but not be limited to, BARACARB® particulates (ground marble, available from Halliburton Energy Services, Inc.) including BARACARB® 5, BARACARB® 25, BARACARB® 150, BARACARB® 600, BARACARB® 1200; STEELSEAL® particulates (resilient graphitic carbon, available from Halliburton Energy Services, Inc.) including STEELSEAL® powder, STEELSEAL® 50, STEELSEAL® 150, STEELSEAL® 400 and STEELSEAL® 1000; WALL-NUT® particulates (ground walnut shells, available from Halliburton Energy Services, Inc.) including WALL-NUT® M, WALL-NUT® coarse, WALL-NUT® medium, and WALL-NUT® fine; BARAPLUG® (sized salt water, available from Halliburton Energy Services, Inc.) including BARAPLUG® 20, BARAPLUG® 50, and BARAPLUG® 3/300; BARAFLAKE® (calcium carbonate and polymers, available from Halliburton Energy Services, Inc.); and the like; and any combination thereof.

Examples of suitable fibers may include, but not be limited to, fibers of cellulose including viscose cellulosic fibers, oil coated cellulosic fibers, and fibers derived from a plant product like paper fibers; carbon including carbon fibers; melt-processed inorganic fibers including basalt fibers, woolastonite fibers, non-amorphous metallic fibers, metal oxide fibers, mixed metal oxide fibers, ceramic fibers, and glass fibers; polymeric fibers including polypropylene fibers and poly(acrylic nitrile) fibers; metal oxide fibers; mixed metal oxide fibers; and the like; and any combination thereof. Examples may also include, but not be limited to, PAN fibers, i.e., carbon fibers derived from poly(acrylonitrile); PANEX® fibers (carbon fibers, available from Zoltek) including PANEX® 32, PANEX® 35-0.125", and PANEX® 35-0.25"; PANOX® (oxidized PAN fibers, available from SGL Group); rayon fibers including BDF™ 456 (rayon fibers, available from Halliburton Energy Services, Inc.); poly(lactide) ("PLA") fibers; alumina fibers; cellulosic fibers; BAROFIBRE® fibers including BAROFIBRE® and BAROFIBRE® C (cellulosic fiber, available from Halliburton Energy Services, Inc.); and the like; and any combination thereof.

In some embodiments, particulates and/or fibers may comprise a degradable material. Nonlimiting examples of suitable degradable materials that may be used in the present invention include, but are not limited to, degradable polymers (crosslinked or otherwise), dehydrated compounds, and/or mixtures of the two. In choosing the appropriate degradable material, one should consider the degradation products that will result. As for degradable polymers, a polymer is considered to be "degradable" herein if the degradation is due to, inter alia, chemical and/or radical process such as hydrolysis, oxidation, enzymatic degradation, or UV radiation. Polymers may be homopolymers, random, linear, crosslinked, block, graft, and star- and hyper-branched. Such suitable polymers may be prepared by polycondensation reactions, ring-opening polymerizations, free radical polymerizations, anionic polymerizations, carbocationic polymerizations, and coordinative ring-opening polymerization, and any other suitable process. Specific examples of suitable polymers include polysaccharides such as dextran or cellulose; chitin; chitosan; proteins; orthoesters; aliphatic polyesters; poly(lactide); poly(glycolide); poly(ε-caprolactone); poly(hydroxybutyrate); poly(anhydrides); aliphatic polycarbonates; poly(orthoethers); poly(amino acids); poly(ethylene oxide); polyphosphazenes; and any combination thereof. Of these suitable polymers, aliphatic polyesters and polyanhydrides are preferred.

Dehydrated compounds may be used in accordance with the present invention as a degradable solid particulate. A dehydrated compound is suitable for use in the present invention if it will degrade over time as it is rehydrated. For example, particulate solid anhydrous borate material that degrades over time may be suitable. Specific examples of particulate solid anhydrous borate materials that may be used include, but are not limited to, anhydrous sodium tetraborate (also known as anhydrous borax) and anhydrous boric acid.

Degradable materials may also be combined or blended. One example of a suitable blend of materials is a mixture of poly(lactic acid) and sodium borate where the mixing of an acid and base could result in a neutral solution where this is desirable. Another example would include a blend of poly (lactic acid) and boric oxide, a blend of calcium carbonate and poly(lactic) acid, a blend of magnesium oxide and poly(lactic) acid, and the like. In certain preferred embodiments, the degradable material is calcium carbonate plus poly(lactic) acid. Where a mixture including poly(lactic) acid is used, in certain preferred embodiments the poly (lactic) acid is present in the mixture in a stoichiometric amount, e.g., where a mixture of calcium carbonate and poly(lactic) acid is used, the mixture comprises two poly (lactic) acid units for each calcium carbonate unit. Other blends that undergo an irreversible degradation may also be suitable, if the products of the degradation do not undesirably interfere with either the conductivity of the filter cake or with the production of any of the fluids from the subterranean formation.

In some embodiments, the concentration of a particulate LCM in a drilling fluid may range from a lower limit of about 0.01 pounds per barrel ("PPB"), 0.05 PPB, 0.1 PPB, 0.5 PPB, 1 PPB, 3 PPB, 5 PPB, 10 PPB, 25 PPB, or 50 PPB to an upper limit of about 150 PPB, 100 PPB, 75 PPB, 50 PPB, 25 PPB, 10 PPB, 5 PPB, 4 PPB, 3 PPB, 2 PPB, 1 PPB, or 0.5 PPB, and wherein the particulate LCM concentration may range from any lower limit to any upper limit and encompass any subset therebetween. In some embodiments, the concentration of a fiber LCM in a drilling fluid may range from a lower limit of about 0.01 PPB, 0.05 PPB, 0.1 PPB, 0.5 PPB, 1 PPB, 3 PPB, 5 PPB, or 10 PPB to an upper limit of about 120 PPB, 100 PPB, 75 PPB, 50 PPB, 20 PPB, 10 PPB, 5 PPB, 4 PPB, 3 PPB, 2 PPB, 1 PPB, or 0.5 PPB, and wherein the fiber LCM concentration may range from any lower limit to any upper limit and encompass any subset therebetween. One skilled in the art, with the benefit of this disclosure, should understand that the concentrations of the particulate and/or fiber LCM can effect the viscosity of the drilling fluid, and therefore, should be adjusted to ensure proper delivery of the various LCM into the wellbore.

In some embodiments, a drilling fluid may optionally comprise a polar organic molecule. In some embodiments, the addition of a polar organic molecule to an oil-based fluid may advantageously increase the efficacy of the LCM therein. Polar organic molecules may be any molecule with a dielectric constant greater than about 2, e.g., diethyl ether (dielectric constant of 4.3), ethyl amine (dielectric constant of 8.7), pyridine (dielectric constant of 12.3), and acetone (dielectric constant of 20.7). Polar organic molecules suitable for use in the present invention may include any polar organic molecule including protic and aprotic organic molecules. Suitable protic molecules may include, but not be limited to, organic molecules with at least one functional group to include alcohols, aldehydes, acids, amines, amides, thiols, and any combination thereof. Suitable aprotic molecules may include, but not be limited to, organic molecules with at least one functional group to include esters, ethers, nitrites, nitriles, ketones, sulfoxides, halogens, and any combination thereof. Suitable polar organic molecules may be cyclic compounds including, but not limited to, pyrrole, pyridine, furan, any derivative thereof, and any combination thereof. Suitable polar organic molecules may include an organic molecule with multiple functional groups including mixtures of protic and aprotic groups. In some embodiments, a drilling fluid may comprise multiple polar organic molecules. In some embodiments, a polar organic molecule may be present in a drilling fluid in an amount from a lower limit of about 0.01%, 0.1%, 0.5%, 1%, 5%, or 10% to an upper limit of about 100%, 90%, 75%, 50%, 25%, 20%, 15%, 10%, 5%, 1%, 0.5%, or 0.1% by volume of the a drilling fluid, and wherein the polar organic molecule concentration may range from any lower limit to any upper limit and encompass any subset therebetween.

In some embodiments, other additives may optionally be included in a drilling fluid. Examples of such additives may include, but are not limited to, salts, weighting agents, inert solids, fluid loss control agents, emulsifiers, dispersion aids, corrosion inhibitors, emulsion thinners, emulsion thickeners, viscosifying agents, surfactants, particulates, proppants, lost circulation materials, pH control additives, foaming agents, breakers, biocides, crosslinkers, stabilizers, chelating agents, scale inhibitors, gas, mutual solvents, oxidizers, reducers, and any combination thereof. A person of ordinary skill in the art, with the benefit of this disclosure, will recognize when an additive should be included in a drilling fluid, as well as an appropriate amount of said additive to include.

II. Numerical Methods

The numerical methods described herein may be able to reconcile complex geometries of fractures and different material properties (e.g., for the LCM and the subterranean formation) with sudden changes in stresses that occur under different pressures.

The numerical methods described herein may be 2-dimensional ("2-D") numerical methods or 3-dimensional ("3-D") numerical methods. It should be noted, that unless otherwise specified, as used herein, the term "numerical methods" encompasses 2-D numerical methods and 3-D numerical methods. The 2-D numerical methods may advantageously require less time and less computing power, while 3-D numerical methods may advantageously be more accurate. As such, 2-D numerical methods may be more applicable to in-the-field methods. In some instance, the outputs of 3-D numerical methods may be utilized to analyze the inputs with the greatest influence on the outputs. A second 3-D numerical method may be configured to accept the inputs of greatest influence, which reduces computing time and may allow for in-field implementation of 3-D numerical methods.

Generally, the numerical methods described herein should be capable of determining the constitutive stress-strain relationship in an elastic regime based on properties of the LCM. Numerical methods described herein may be open-form methods or closed-form methods. In some embodiments, the numerical method utilized for in-the-field applications may be a closed-form algorithm, which are generally less complex and faster. In some instance, an open-form numerical method described herein may be used to develop a closed-form algorithm, e.g., by analyzing the primary LCM inputs, wellbore inputs, or subterranean formation inputs that effect the outputs.

Example of suitable numerical methods may include, but are not limited to, Finite Element Analysis (FEA), Finite Difference Method (FDM), Boundary Element Method (BEM), Superposition Beam Model (SBM), Discrete Element Model (DEM), and the like, and hybrids thereof. In some embodiments, numerical methods may model half or a quarter of the wellbore under the assumption that the wellbore is symmetrical. As such, the numerical method may include symmetry boundary conditions at the interface where the other half or three quarter wellbore would be.

One skilled in the art, with the benefit of this disclosure, would recognize that the numerical methods may be closed-form (i.e., equation based), open-form (i.e., iterative optimization typically with neural networks), or a hybrid thereof.

The numerical methods utilize inputs that may include, but are not limited to, the wellbore configuration, the wellbore conditions, the properties of the near-wellbore subterranean formation, the fracture properties, the properties of the LCM, the properties of the drilling fluid, the properties of the plug, and the like. The numerical methods then provide outputs that may include, but are not limited to, the properties of the plug, the wellbore stresses, suggested operational parameters, and the like.

Examples of wellbore configuration inputs may include, but are not limited to, wellbore diameter, wellbore angle, lithology, azimuth, and the like.

Examples of wellbore condition inputs may include, but are not limited to, pressure inside the wellbore, pressure readings during drilling, pressure readings during previous wellbore strengthening operations, temperature gradient, and the like.

Examples of near-wellbore subterranean formation property inputs may include, but are not limited to, subterranean formation modulus, Poisson's ratio of the subterranean formation, initial formation stress, in situ horizontal and vertical stress, pore pressure gradient, pore sizes, fracture gradient, permeability, activity coefficient (i.e., a measure of the chemical reactivity of the formation), and the like.

Examples of fracture inputs may include, but are not limited to, fracture length (i.e., distance the fracture extends into the subterranean formation from the wellbore), fracture width (i.e., size of the fracture opening along the circumference of the wellbore), fracture height (i.e., dimension of the fracture along the length of the wellbore), fracture shape, fracture surface roughness, and the like.

Examples of LCM property inputs may include, but are not limited to, LCM composition, LCM size, LCM shape, LCM Young's modulus, LCM crush strength, LCM resiliency, LCM cyclic fatigue, LCM shear strength, LCM compressive strength, the relative concentrations of two or more LCM, reactivity of the LCM, LCM wetting contact angle, LCM adhesiveness, LCM electrical or magnetic property, LCM electrostatic charge, LCM thermal stability, and the like.

Examples of drilling fluid property inputs may include, but are not limited to, weight, yield point, plastic viscosity, oil/water ratio (e.g., for emulsions and invert emulsions), chemical reactivity of individual components of the drilling fluid, and the like.

For the numerical methods described herein, individual plug properties may independently be an input or an output. For example, in some instances, plug properties may be measured in a laboratory and used as an input. In another example, the wellbore configuration, the wellbore conditions, the properties of the near-wellbore subterranean formation, the fracture properties, the properties of the LCM, and combinations thereof may be used to model the plug properties. Examples of plug property inputs or outputs may include, but are not limited to, plug modulus, plug break pressure, LCM packing density, and the like.

Examples of wellbore stress outputs may include, but are not limited to, quantitative values of hoop stress, qualitative hoop stress (i.e., tensive hoop stress or compressive hoop stress), fracture pressure, fracture pressure gradient, stress intensity factor (i.e., fracture toughness), and the like.

Examples of suggested operational parameter outputs may include, but are not limited to, equivalent circulating density, drilling depth, the degree of pressure increases in a wellbore strengthening operation, rate of penetration, pump rates, pipe tripping speed, drilling fluid properties (including those listed above), replenishing rates for LCM (e.g., due to attrition in LCM), other pills or background treatments, and the like.

Some embodiments may involve inputting a plurality of first inputs into a numerical method described herein; calculating a plurality of first outputs from the numerical method; inputting a plurality of second inputs into the numerical method; calculating a plurality of second outputs from the numerical method; and comparing the first outputs to the second outputs for enhanced wellbore strengthening. One of skill in the art would recognize how the various outputs effect wellbore strengthening and be able to ascertain from a comparison of outputs how to implement greater wellbore strengthening. Implementation of greater wellbore strengthening (e.g., developing a drilling fluid, changing drilling parameters, or the like) may be by implementing the inputs analyzed by the numerical method or by implementing inputs that are similar to the inputs analyzed by the numerical method (e.g., analyzing first and second inputs (e.g., an LCM, an LCM property, or a drilling parameter) and then implementing a third input (e.g., an LCM, LCM property, or a drilling parameter different than those analyzed). By way of nonlimiting example, a two-component LCM may be analyzed where the ratio of the two components are varied (e.g., 10:1, 5:1, 1:1, 1:5, and 1:10) and analyzed via the numerical method. Then, based on the comparison of outputs from the numerical method, a two-component LCM may be implemented that has a ratio of components different than what was analyzed (e.g., 1:2). Implementation of a different LCM component ratio may be based on the step change in wellbore strengthening as indicated from the outputs, the cost associated with individual LCM components, the availability of the LCM components, and the like. Relative to drilling parameters, implementation of a drilling parameter not analyzed may be based on the amount of wellbore strengthening provided, the operational limitations of the equipment available for to an operator (e.g., an ECD may be suggested that is outside prevue of the operate such that the operator may operate at an ECD not analyzed), and the like. One skilled in the art would recognize how this nonlimiting example translates to other inputs and outputs.

In some embodiments, the first and second inputs may be variations of one or more inputs described herein. For example, the first inputs may include the Young's modulus for a first LCM and a plurality of subterranean formation inputs and wellbore inputs described herein, while the second input may be the Young's modulus for a second LCM and the same plurality of subterranean formation inputs and wellbore inputs. In a second example, the first inputs may include a first wellbore pressure and a plurality of subterranean formation inputs, LCM inputs, and other wellbore inputs described herein, while the second input may be a second wellbore pressure and the same plurality of subterranean formation inputs, LCM inputs, and other wellbore inputs. In a third example, a hybrid of the first and second examples may be performed where a series of wellbore pressures are analyzed relative to at least two different LCM and the outputs of each may be compared.

In some embodiments, the number of iteration of the above general procedure may be any desired amount (e.g., 2, 10, 100, 1000, and so on) to achieve the desired number of outputs for the comparison.

For example, a numerical method may be utilized to provide at least one wellbore stress output (e.g., a fracture pressure, hoop stress, or both) of a wellbore having a fracture plugged with one of three different LCM: (1) a highly resilient LCM, (2) a less resilient, high modulus material, and (3) a mixture of (1) and (2). Keeping the other inputs constant including wellbore pressure, the numerical model may produce outputs including the hoop stress. Examples of suitable models for such analysis may include, but are not limited to, an FEA, an FDM, a BEM, or a hybrid thereof.

In a second example, a numerical method may be utilized to provide a wellbore stress output and a plug property output (e.g., plug porosity), for a wellbore having a fracture plugged. As these two outputs relate to the primary failure mechanisms in wellbore strengthening (i.e., (1) transition from compressive hoop stress to tensile hoop stress and (2) plug failure), analyzing both may allow for identifying which failure mechanism is dominant for various LCMs under specific conditions (i.e., the inputs described herein) and/or for a specific LCM or series of LCMs under various conditions. In some instances, the LCMs may be ranked based on the highest equivalent circulating density that can be achieved without failure in wellbore strengthening, which may include values or ranges that correspond to inputs (e.g., a range for at least one wellbore configuration, wellbore condition, and/or property of the near-wellbore subterranean formation). Examples of suitable models for such analysis may include, but are not limited to, the foregoing methods adapted to include a shear-failure analysis (e.g., a Drucker-Prager Shear Failure analysis). One skilled in the art with the benefit of this disclosure would understand the Drucker-Prager Shear Failure analysis is a pressure-dependent model that analyzes plastic yield of a material and may take various forms to incorporate uniaxial asymmetry, cohesion, the angle of internal friction, and the like.

The outputs may, in some embodiments, then be utilized in a plurality of methods, which may in-the-field or otherwise, to determine a preferred LCM for utilization in a drilling operation, a wellbore strengthening operation, and the like. The outputs may, in some embodiments, also be utilized in a plurality of methods, which may in-the-field or otherwise, to predict the performance of an available LCM for utilization in a drilling operation, a wellbore strengthening operation, and the like.

In some embodiments, the outputs may be utilized to create a data library. The data library may, in some embodiments, be used as an additional source of inputs in executing future numerical methods, which may advantageously increase accuracy and reduce runtime.

Generally, due to the complexity of the numerical method, it is under computer control. In some embodiments, the numerical method may produce outputs that are readable to an operator who can manually take appropriate action, if needed, based upon the reported output. In some embodiments, the numerical method may produce an output that causes an automated action a downhole tool or control system related thereto. In addition, the inputs and outputs can be communicated (wired or wirelessly) to a remote location by a communication system (e.g., satellite communication or wide area network communication) for further analysis or remote real-time interaction (e.g., via real-time analysis or real-time actions, each of which may be manual and/or automated).

It is recognized that the numerical methods and computer control (including various blocks, modules, elements, components, methods, and algorithms) can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the numerical methods and the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences (e.g., those related to the numerical methods described herein) can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

III. Methods

For simplicity, the methods described herein may utilize the term "comparison of outputs" in reference to the general comparison method described above. That is, some embodiments may involve inputting a plurality of first inputs into a numerical method described herein; calculating a plurality of first outputs from the numerical method; inputting a plurality of second inputs into the numerical method; calculating a plurality of second outputs from the numerical method; and comparing the first outputs to the second outputs. In some embodiments, the first and second inputs may variations of one or more inputs described herein.

Some embodiments may involve providing or performing a comparison of outputs based on inputs comprising the properties of a plurality of LCM; and developing a drilling fluid based on the comparison of outputs. It should be noted that in the methods described herein where specific inputs or outputs are given, the method is referring to inputs or outputs comprising the specific inputs or outputs given, respectively. That is, the methods described herein encompass the use of other inputs and outputs described herein that are not specified in that method description.

Some embodiments may involve providing a wellbore with a first equivalent circulating density; providing or performing a comparison of outputs based on inputs comprising the properties of a plurality of LCM; and drilling a portion of the wellbore with a drilling fluid at a second equivalent circulating density greater than the first equivalent circulating density, the drilling fluid comprising an LCM based on the plurality of outputs.

Some embodiments may involve obtaining a plurality of pressure readings while drilling a wellbore; using the pressure readings as inputs in a numerical analysis for performing a comparison of outputs; and developing a drilling fluid based on the comparison of outputs.

Some embodiments may involve providing a wellbore with a first equivalent circulating density; providing a plurality of wellbore conditions relating to a first wellbore strengthening operation performed with a first drilling fluid comprising a first LCM; using the wellbore conditions as inputs in a numerical analysis for performing a comparison of outputs; and drilling a portion of the wellbore with a drilling fluid at a second equivalent circulating density greater than the first equivalent circulating density, the drilling fluid comprising a second LCM based on the plurality of outputs.

Embodiments disclosed herein include:

A. a method that includes inputting a plurality of first inputs into a numerical method, the plurality of first inputs comprising a lost circulation material property input of a first LCM; calculating a plurality of first outputs from the numerical method; inputting a plurality of second inputs into the numerical method, the plurality of second inputs comprising the lost circulation material property input of a second lost circulation material; calculating a plurality of second outputs from the numerical method; comparing the first outputs to the second outputs; and developing a drilling fluid comprising a third lost circulation material based on the comparison of outputs;

B. a method that includes providing a wellbore with a first equivalent circulating density; inputting a plurality of first inputs into a numerical method, the plurality of first inputs comprising a lost circulation material property input of a first lost circulation material; calculating a plurality of first outputs from the numerical method; inputting a plurality of second inputs into the numerical method, the plurality of second inputs comprising the lost circulation material property input of a second lost circulation material; calculating a plurality of second outputs from the numerical method; comparing the first outputs to the second outputs; and drilling a portion of the wellbore with a drilling fluid at a second equivalent circulating density greater than the first equivalent circulating density, the drilling fluid comprising a third lost circulation material based on the plurality of outputs; and C. a method that includes inputting a plurality of first inputs into a numerical method, the plurality of first inputs comprising a first wellbore condition input from a drilling operation; calculating a plurality of first outputs from the numerical method; inputting a plurality of second inputs into the numerical method, the plurality of second inputs comprising a second wellbore condition input from the drilling operation; calculating a plurality of second outputs from the numerical method; comparing the first outputs to the second outputs; and developing a drilling fluid comprising a lost circulation material based on the comparison of outputs.

Embodiment A and B may have one or more of the following additional elements in any combination: Element 1: wherein the first lost circulation material, second lost circulation material, and third lost circulation material each comprise a first particulate and a second particulate in different relative ratios; and Element 2: wherein the first lost circulation material, second lost circulation material, and third lost circulation material each comprise a first particulate and a second fiber in different relative ratios.

Each of embodiments A, B, and C may have one or more of the following additional elements in any combination: Element 3: wherein the lost circulation material (or first, second, or third lost circulation material) comprises at least one particulate; Element 4: wherein the lost circulation material (or first, second, or third lost circulation material) comprises at least one fiber; Element 5: wherein the lost circulation material (or first, second, or third lost circulation material) comprises at least one particulate and at least one fiber; Element 6: wherein the numerical method is at least one selected from the group consisting of Finite Element Analysis, Finite Difference Method, Boundary Element Method, Superposition Beam Model, and any hybrid thereof; Element 7: wherein the numerical method is an open-form model; Element 8: wherein the lost circulation material property input is at least one selected from the group consisting of size, shape, Young's modulus, crush, resiliency, cyclic fatigue, shear strength, compressive strength, material reactivity, and any combination thereof; Element 9: wherein the first outputs and the second outputs are a hoop stress; Element 10: wherein the first outputs and the second outputs are a hoop stress and a plug break point; Element 11: wherein the first inputs and the second inputs both further comprise wellbore condition inputs relating to a previous wellbore strengthening operation; Element 12: wherein the first inputs and the second inputs both further comprise wellbore condition inputs relating to a drilling operation; and Element 13: the method further including drilling at least a portion of the wellbore with the drilling fluid.

By way of non-limiting example, exemplary combinations applicable to A, B, and C include: Element 11 in combination with one of Elements 9-10; Element 12 in combination with one of Elements 9-10; Element 8 in combination with one of Elements 9-10; two or more of Elements 8 and 11-12 in combination with one of Elements 9-10; Element 6 in combination with at least one of Elements 8 and 11-12; Element 6 in combination with at least one of Elements 9-10; Element 6 in combination with at least one of Elements 8 and 11-12 and at least one of Elements 9-10; Element 7 in combination with any of the foregoing; one of Elements 1-5 in combination with any of the foregoing; and Element 13 in combination with any of the foregoing.

To facilitate a better understanding of the embodiments of the present invention, the following examples of preferred or representative embodiments are given. In no way should the following examples be read to limit, or to define, the scope of the invention.

EXAMPLES

Example 1

A finite element analysis was performed with ANSYS® software (available from Ansys, Inc.) to analyze the effect of LCM properties (specifically Young's modulus) on the permeability of the LCM plug. Lower LCM plug permeability translates to better fracture tip isolation and greater wellbore strengthening.

Figure 5:
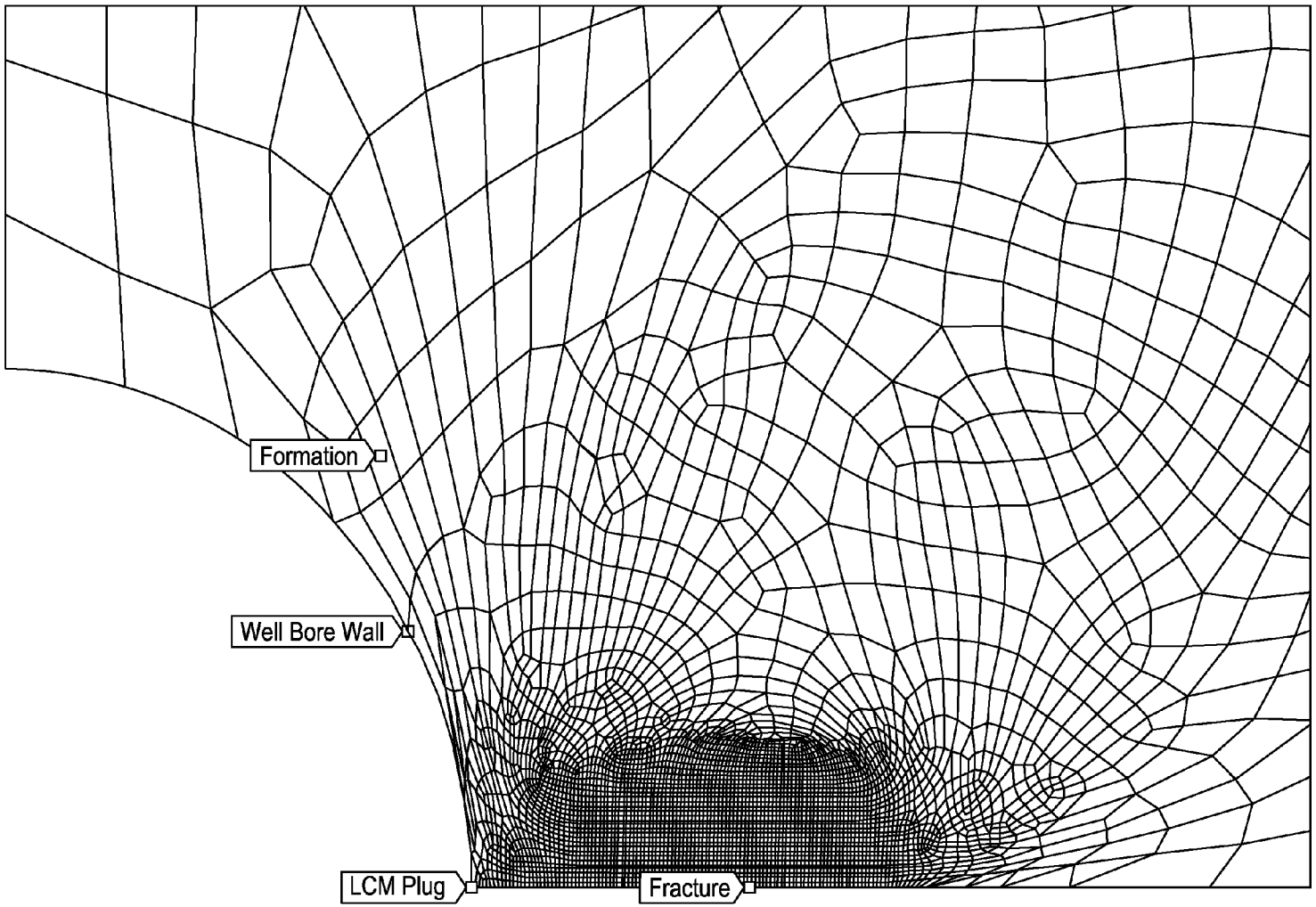
FIG. 5 provides an illustration of a meshed quarter wellbore having a fracture and LCM plug that was modeled using a close-form numerical method described herein.
Figure 6:
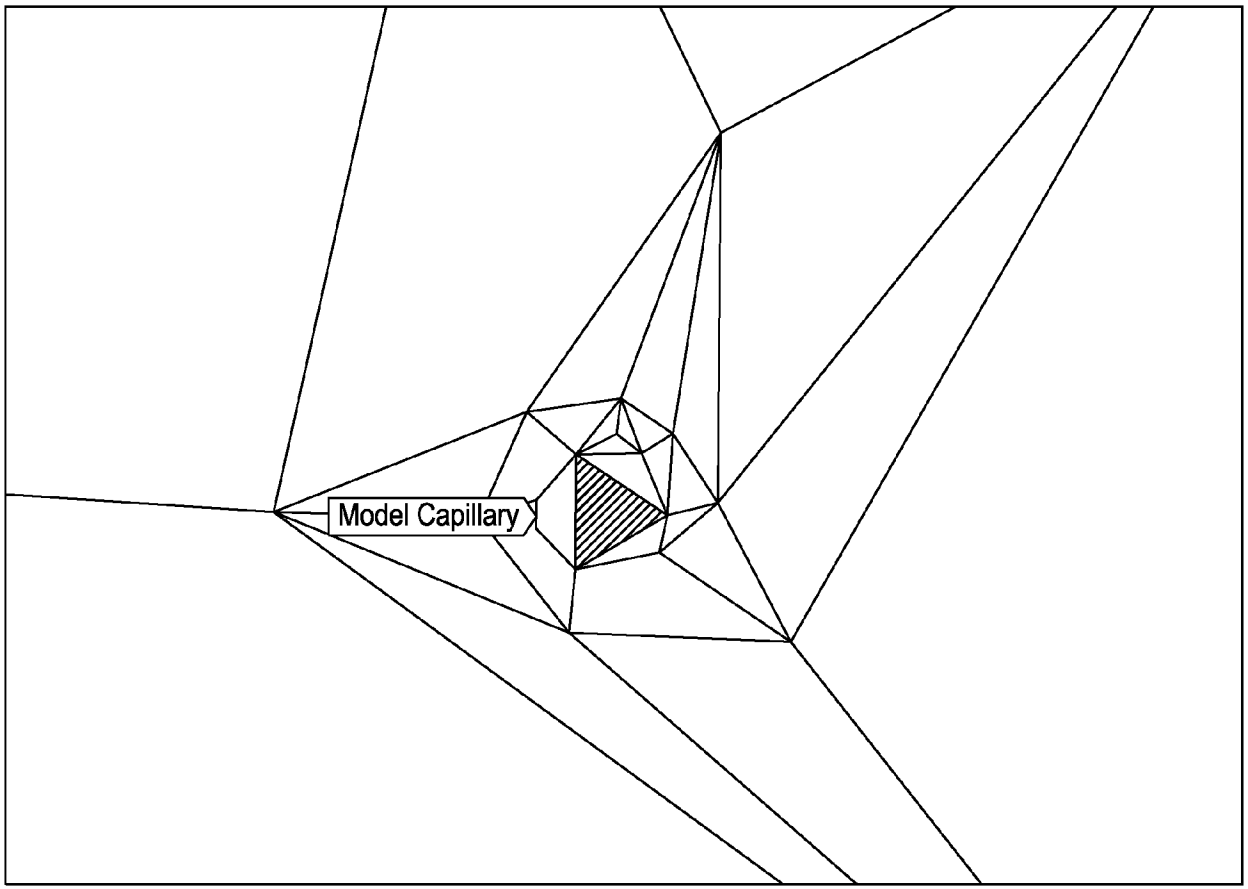
FIG. 6 provides a cross-sectional illustration of the LCM plug of FIG. 5.
Figure 7:
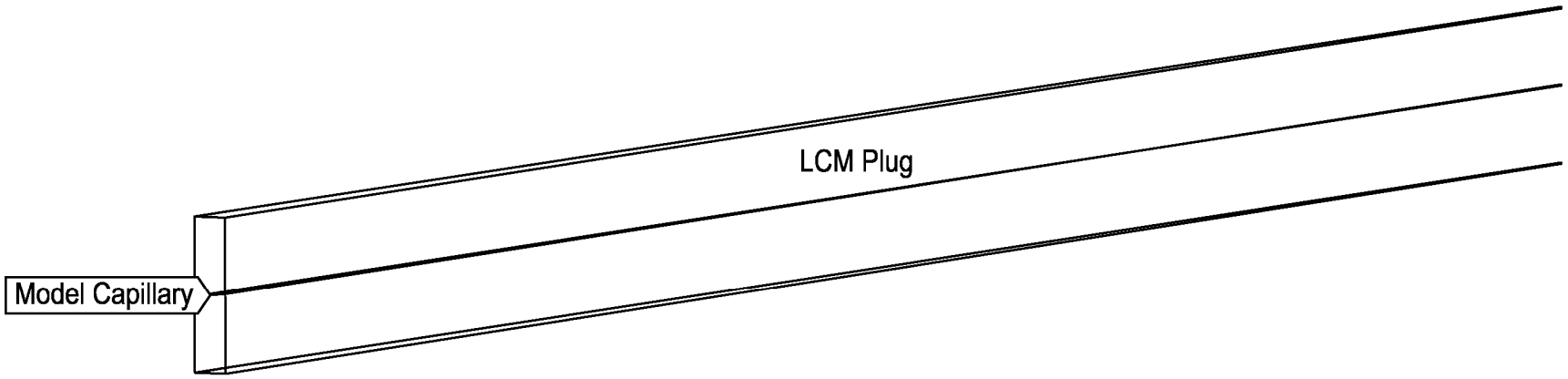
FIG. 7 provides an illustration of the LCM plug extending along the length of the fracture of FIG. 5.

A quarter wellbore was built and meshed with the software (FIG. 5). The LCM plugged fracture was modeled along one edge of the quarter view as illustrated in FIG. 5. A capillary was modeled in the LCM plug as a channel having an equilateral triangular cross-section (FIG. 6) and extending through the center of the plug along the length of the fracture (FIG. 7). Initially, the capillary had mesh nodal locations that could change location during the numerical method. During the numerical method, the cross-sectional area of the capillary at about midway along the length of the capillary was calculated as the LCM properties were changed. Changes to the capillary area indicate changes to the permeability of the LCM plug.

Table 1 provides the inputs that were kept constant for the various numerical methods, where the formation stresses were equal in all directions. Table 2 provides the variable inputs (LCM properties) and output (capillary cross-sectional area) used in this numerical method.

TABLE 1

| Loading Conditions - Inputs | |
|---|---|
| Formation X-Axis Stress (max horizontal stress) (psi) | 8,000 |
| Formation Y-Axis Stress (min horizontal stress) (psi) | 8,000 |
| Formation Z-Axis Stress (overburden pressure) (psi) | 8,000 |
| Borehole Pressure (psi) | 7,540 |
| Fracture Pore Pressure (psi) | 2,232 |
| LCM Plug Pore Pressure (psi) | 2262-0 |
| Formation Pore Pressure (psi) | 7,440 |
| LCM Plug Capillary Pressure (psi) | 7540-7440 |

TABLE 1-continued

| Formation Properties - Inputs | |
|---|---|
| Density (lb*in$^{-3}$) | 0.001559 |
| Young's Modulus (psi) | 1.50*10$^6$ |
| Poisson's Ratio | 0.33 |
| Bulk Modulus | 1.47*10$^6$ |
| Shear Modulus | 5.64*10$^5$ |

TABLE 2

| | LCM Properties - Inputs | | | | Output |
|---|---|---|---|---|---|
| Case Number | Young's Modulus (psi) | Bulk Modulus (psi) | Poisson's Ratio | Shear Modulus (psi) | Capillary X-Sect. Area (in$^2$) |
| 1 | 170,000 | 166,667 | 0.33 | 63,910 | $1.22 \times 10^{-6}$ |
| 2 | 85,000 | 83,333 | 0.33 | 31,955 | $1.13 \times 10^{-6}$ |
| 3 | 340,000 | 333,333 | 0.33 | 127,820 | $1.24 \times 10^{-6}$ |
| 4 | 170,000 | 113,333 | 0.25 | 68,000 | $1.21 \times 10^{-6}$ |

Comparing cases 1-3, the most resilient LCM (i.e., the lowest Young's modulus, case 2) forms a plug with the lowest permeability (i.e., a smaller cross-sectional area). This may translate to better isolation of the tip of the fracture from the wellbore and provide greater wellbore strengthening.

Comparing cases 1 and 4, reducing the Poison's ratio appears to also decrease permeability of the plug, but perhaps not to the extent that decreasing both bulk and Young's modulus.

Example 2

In another example with the same procedure as Example 1, the loading condition inputs were changed to those in Table 3. These loading condition inputs indicate stress state of the formation. The variable inputs are provided in Table 4.

TABLE 3

| Loading Conditions - Inputs | |
|---|---|
| Formation X-Axis Stress (max horizontal stress) (psi) | 8,000 |
| Formation Y-Axis Stress (min horizontal stress) (psi) | 7,000 |
| Formation Z-Axis stress (overburden pressure) (psi) | 10,500 |
| Borehole Pressure (psi) | 7,000 |
| Fracture Pore Pressure (psi) | 1,395 |
| LCM Plug Pore Pressure (psi) | 2100-0 |
| Formation Pore Pressure (psi) | 4,650 |
| LCM Plug Capillary Pressure (psi) | 7000-4650 |
| **Formation Properties - Inputs** | |
| Density (lb*in$^{-3}$) | 0.001559 |
| Young's Modulus (psi) | 1.50*10$^6$ |
| Poisson's Ratio | 0.33 |
| Bulk Modulus | 1.47*10$^6$ |
| Shear Modulus | 5.64*10$^5$ |

TABLE 4

| | LCM Properties - Inputs | | | | Output |
|---|---|---|---|---|---|
| Case Number | Young's Modulus (psi) | Bulk Modulus (psi) | Poisson's Ratio | Shear Modulus (psi) | Capillary X-Sect. Area (in$^2$) |
| 5 | 170,000 | 166,667 | 0.33 | 63,910 | $1.22 \times 10^{-6}$ |
| 6 | 85,000 | 83,333 | 0.33 | 31,955 | $1.18 \times 10^{-6}$ |
| 7 | 340,000 | 333,333 | 0.33 | 127,820 | $1.23 \times 10^{-6}$ |
| 8 | 170,000 | 113,333 | 0.25 | 68,000 | $1.21 \times 10^{-6}$ |

Similar as seen in Example 1 but with the different loading conditions or initial stress state of the formation, the most resilient LCM (i.e., case 6) provides for a plug that enhances wellbore strengthening. However, the effect of the resiliency of the LCM on plug porosity is not as dramatic as Example 1, while the effect of Poison's ratio appears to have the same effect on plug porosity. This may indicate that the magnitude of the effect of different LCM properties on plug porosity and wellbore strengthening is dependent on the formation properties and drilling conditions. As such, the numerical methods described herein that take into account, inter alia, the formation properties and drilling conditions may be particularly useful in designing lost circulation materials.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

inputting a plurality of first inputs into a numerical method, the plurality of first inputs comprising a lost circulation material property input of a first lost circulation material, wherein the lost circulation material property input is selected from the group consisting of Young's modulus, crush strength, resiliency, cyclic fatigue, shear strength, compressive strength, material reactivity, and any combination thereof;

calculating a plurality of first outputs from the numerical method;

inputting a plurality of second inputs into the numerical method, the plurality of second inputs comprising the lost circulation material property input of a second lost circulation material;

calculating a plurality of second outputs from the numerical method, wherein one of the first outputs and the second outputs comprise a plug break point;

comparing the first outputs to the second outputs; and developing a drilling fluid comprising a third lost circulation material based on the comparison of outputs.

2. The method of claim 1, wherein the first lost circulation material, the second lost circulation material, and the third lost circulation material each comprise a first particulate and a second particulate in different relative ratios.

3. The method of claim 1, wherein the first lost circulation material, the second lost circulation material, and the third lost circulation material each comprise a first particulate and a second fiber in different relative ratios.

4. The method of claim 1, wherein the numerical method is at least one selected from the group consisting of Finite Element Analysis, Finite Difference Method, Boundary Element Method, Superposition Beam Model, and any hybrid thereof.

5. The method of claim 1, wherein the numerical method is an open-form model.

6. The method of claim 1, wherein the first outputs and the second outputs are a hoop stress.

7. The method of claim 1, wherein the first outputs and the second outputs are a hoop stress and a plug break point, respectively.

8. The method of claim 1, wherein the first inputs and the second inputs both further comprise wellbore condition inputs relating to a previous wellbore strengthening operation.

9. The method of claim 1, wherein the first inputs and the second inputs both further comprise wellbore condition inputs relating to a drilling operation.

10. The method of claim 1 further comprising:

drilling at least a portion of the wellbore with the drilling fluid.

11. A method comprising:

providing a wellbore with a first equivalent circulating density;

inputting a plurality of first inputs into a numerical method, the plurality of first inputs comprising a lost circulation material property input of a first lost circulation material wherein the lost circulation material property input is selected from the group consisting of Young's modulus, crush strength, resiliency, cyclic fatigue, shear strength, compressive strength, material reactivity, and any combination thereof;

calculating a plurality of first outputs from the numerical method;

inputting a plurality of second inputs into the numerical method, the plurality of second inputs comprising the lost circulation material property input of a second lost circulation material;

calculating a plurality of second outputs from the numerical method, wherein one of the first outputs and the second outputs comprise a plug break point;

comparing the first outputs to the second outputs; and drilling a portion of the wellbore with a drilling fluid at a second equivalent circulating density greater than the first equivalent circulating density, the drilling fluid comprising a third lost circulation material based on the plurality of outputs.

12. The method of claim 11, wherein the numerical method is at least one selected from the group consisting of Finite Element Analysis, Finite Difference Method, Boundary Element Method, Superposition Beam Model, and any hybrid thereof.

13. The method of claim 11, wherein the numerical method is an open-form model.

14. The method of claim 11, wherein the lost circulation material property input is at least one selected from the group consisting of size, shape, Young's modulus, crush, resiliency, cyclic fatigue, shear strength, compressive strength, material reactivity, and any combination thereof.

15. The method of claim 11, wherein the first outputs and the second outputs are a hoop stress.

16. The method of claim 11, wherein the first outputs and the second outputs are a hoop stress and a plug break point, respectively.

17. A method comprising:

inputting a plurality of first inputs into a numerical method, the plurality of first inputs comprising a first wellbore condition input from a drilling operation;

calculating a plurality of first outputs from the numerical method;

inputting a plurality of second inputs into the numerical method, the plurality of second inputs comprising a second wellbore condition input from the drilling operation;

calculating a plurality of second outputs from the numerical method, wherein the first outputs and the second outputs comprise a plug break point;

comparing the first outputs to the second outputs; and developing a drilling fluid comprising a lost circulation material based on the comparison of outputs.

* * * * *